US006160512A

United States Patent [19]

Desclos et al.

[11] Patent Number: 6,160,512

[45] Date of Patent: Dec. 12, 2000

[54] MULTI-MODE ANTENNA

[75] Inventors: Laurent Desclos; Mohammad Madihian, both of Tokyo, Japan

[73] Assignee: NEC Corporation, Tokyo, Japan

[21] Appl. No.: 09/174,441

[22] Filed: Oct. 19, 1998

[30] Foreign Application Priority Data

Oct. 20, 1997 [JP] Japan ..... 9-286310
Oct. 28, 1997 [JP] Japan ..... 9-295066

[51] Int. Cl.[7] ..... H01Q 1/38

[52] U.S. Cl. ..... 343/700 MS; 343/725

[58] Field of Search ..... 343/700 MS, 725, 343/729, 829, 846; H01Q 1/38

[56] References Cited

U.S. PATENT DOCUMENTS 5,300,936 4/1994 Izadian ..... 343/727
5,926,146 7/1999 Seck ..... 343/725

FOREIGN PATENT DOCUMENTS

S57-63941 4/1982 Japan .
S5-299925 11/1993 Japan .
S9-98017 4/1997 Japan .

OTHER PUBLICATIONS

Mobile Antenna System Handbook, Fujimoto and James, Artech House 1994, pp. 154–155, 235–239, and 455–457.

*Primary Examiner*—Michael C. Wimer
*Attorney, Agent, or Firm*—Sughrue, Mion, Zinn, Macpeak & Seas, PLLC

[57] ABSTRACT

A linear antenna, such as a monopole antenna, is placed in the axis of a circular polarized antenna, such as a printed patch antenna or a helical antenna. The linear antenna can be optimized for a terrestrial communication system while the circular polarized antenna can be optimized for a satellite system.

7 Claims, 14 Drawing Sheets

MULTI-MODE ANTENNA

BACKGROUND OF THE INVENTION

The present invention claims priorities from Japanese Patent Applications No. 9-286310 filed Oct. 20, 1997 and No. 9-295066 filed Oct. 28, 1997, which are incorporated herein by reference.

1. Field of the Invention

The present invention relates to a multi-mode antenna which has multiple working frequencies and polarizations.

2. Description of Related Art

Although a multi-mode antenna which can be used for various communication systems, including a terrestrial system and a satellite system, is desirable no possible solution for such a multi-mode antenna has been proposed but by combining existing available antennas.

FIG. 1 shows an example of a possible combination based on existing available antennas. In this example, a monopole antenna 101 (see "Mobile antenna Systems handbook", Fujimoto and James, Artech House 1994, pp.154–155) and a helical antenna 102 (see pp. 455–457 of the above-mentioned handbook) are mounted on a body 103 of a mobile terminal such as a handy-phone with a distance $D_{111}$. The monopole antenna 101 is in this case dedicated to the terrestrial communication system, such as GSM, and the helical antenna 102 is for the satellite type of communication with a circular polarization. The distance $D_{111}$ has to be optimized for non perturbation of each diagram.

FIG. 2 shows another example of a combination of a PIFA antenna 201 (see pp. 235–239 of the above-mentioned handbook) mounted behind a body 203 of the handy-phone. Above the same body 203, an helical antenna 202 is mounted and separated from the other antenna 201. The PIFA antenna 201 is in this case dedicated to the terrestrial communication system, and the helical antenna 202 is for the satellite type of communication with a circular polarization. The placement of each of the antennas has to be optimized for the best performance.

One problem of prior art is that is uses multiple antennas, in fact one per application desired, this is then consuming a lot of space which is not suitable for integration on small portable devices. The cost of machining the structure also can increase since the structure is using separated antennas on the structure and location of antennas interaction between each of them has to studied each time. It requires a long investigation and trimming time.

Another problem of prior art is that most antenna structures are bulky and large so that the size of the antenna may become a critical point of the size of a mobile terminal. If the terminal needs to use more than one of the antennas, these antennas have to be combined on one body of the terminal multiplying the space consumed.

Further problem is that users have to determine from which system, either satellite or terrestrial,the terminal is receiving the call and which antenna should be pulled out for use. This is not so practical.

SUMMARY OF THE INVENTION

The present invention aims to provide a multi-mode antenna which can be implemented on personal communication applications.

A multi-mode antenna of the present invention is characterized by a linear antenna being placed in the axis of a circular polarized antenna which generates a circular polarization.

The circular polarized antenna may be a printed patch antenna with a slot in its center and a monopole antenna may be placed in the slot. The patch antenna is printed on a backgrounded substrate with a thickness T and a permittivity P. The feeding system of the patch is defined as a probe located to achieve the best axial ratio. The slot dimensions $D_1$ and $D_2$ are determined to achieve the best axial ratio and allowing the monopole antenna to pass through a hole going through the entire substrate. The dimensions $L_1$ and $L_2$ of the patch are determined to give circular polarization at a frequency $F_1$ with low axial ratio while the monopole length $L_3$ is determined to be accorded to the frequency $F_2$ and allowing the vertical polarization. The feeding system for the monopole antenna is placed behind the patch structure.

It may be incorporated instead of the simple hole a complete structure made to match with a specific dipole. Often this structure is based on a ground plane with a part of tube of a certain diameter $D_T$ and a height $H_T$. The monopole antenna is then placed centered in the middle of this tube which is either in metal or in composite metal. The monopole antenna may also be replaced by any other type of antenna generating a linear vertical polarization such as a dipole antenna. This type of antenna may be retractable or not.

It may be included more than one stacked patches to have more bandwidth. The first patch antenna is printed on a backgrounded substrate with a thickness $T_1$ and a permittivity $P_1$. The feeding system of the patch is defined as a probe located to achieve the best axial ratio. The slot dimension $D_{11}$ and $D_{12}$ are determined to achieve the best axial ratio and allowing to let pass the monopole antenna through another hole going through the entire substrate. The dimensions $L_{11}$ and $L_{12}$ of the patch are determined to give circular polarization at a frequency $F_1$ with low axial ratio. Another patch is printed on a non backgrounded substrate with a thickness $T_2$ and a permittivity $P_2$. A slot is placed at its center with dimension $D_{21}$ and $D_{22}$ and the dimensions of the patch are $L_{21}$ and $L_{22}$. All the dimensions are made to compromise the matching, the gain in circular polarization and the axial ratio at another frequency $F_3$. Through the slots of the first and second patch antennas is going a hole which is able to let through the monopole antenna.

The circular polarized antenna may be a helical antenna which is composed of N wires wrapped around a transparent cylinder for generating a circular polarization and a monopole antenna may be placed in the axis of the helical antenna to stand above a conducting plane on which this multi-mode antenna is formed. Each of the wires of the helical antenna is connected to individual one of N outputs of a first feeder which have a common entry to feed the N outputs in appropriate way (phase and magnitude). The monopole antenna is connected to a second feeder which is placed along the axis and on the same supporting structure as that of the first feeder.

On this structure, the diameter of the cylinder, the number N of the wires, the pitch angle, the length of the wires and the feeding phases and magnitudes are determining the radiation pattern of the satellite communication system portable antenna. The monopole length $L_{22}$, the loading structure which is terminating the monopole antenna and the surrounding structure are determining the radiation pattern and the matching of the monopole antenna. By determining the diameter of the wires, the interaction on the monopole can be optimized.

On the above-mentioned structures, the resonant frequency of the monopole antenna is determined by its length which is approximately a quarter wavelength of the desired frequency. The feeding system and the support structure is designed for having a complete matching and giving power at frequency $F_1$ in a linear polarization for the terrestrial coverage.

The patch structure is itself giving rise to a circular polarization for satellite communication system. This patch is optimized to fit with the requirements of the axial ratio, frequency and gain at a frequency $F_2$. Both antennas are first designed in a separated way, since the monopole type antenna and feeding structure is of revolution type, placed in the middle of the patch, and the frequency are different, each of them does not affect the other one. However when designing, it is more easy to design first the monopole structure and then include the patch around and optimize it in a interactive measurement way.

The helical antenna is designed in a complete separated way to achieve the coverage of the satellite type communications. It consists in a set of wires wrapped around a transparent cylinder and fed different amplitudes and phases. This antenna will be the antenna for the satellite communication system. Since the satellite antenna is circularly polarized and with a symmetry of revolution, it is then possible to insert the monopole inside. The overall behavior will be then matched externally within the feeder systems to compensate the small effects on impedance leveling. The small changes on the pattern will be also improved by re-optimizing the helical with respect to the monopole type.

BRIEF DESCRIPTION OF THE DRAWINGS

Preferred embodiments of the present will be described in detail with reference to the accompanying drawings, wherein.

DETAILED DESCRIPTION OF THE PREFERRED EMBODIMENTS

Figure 1:
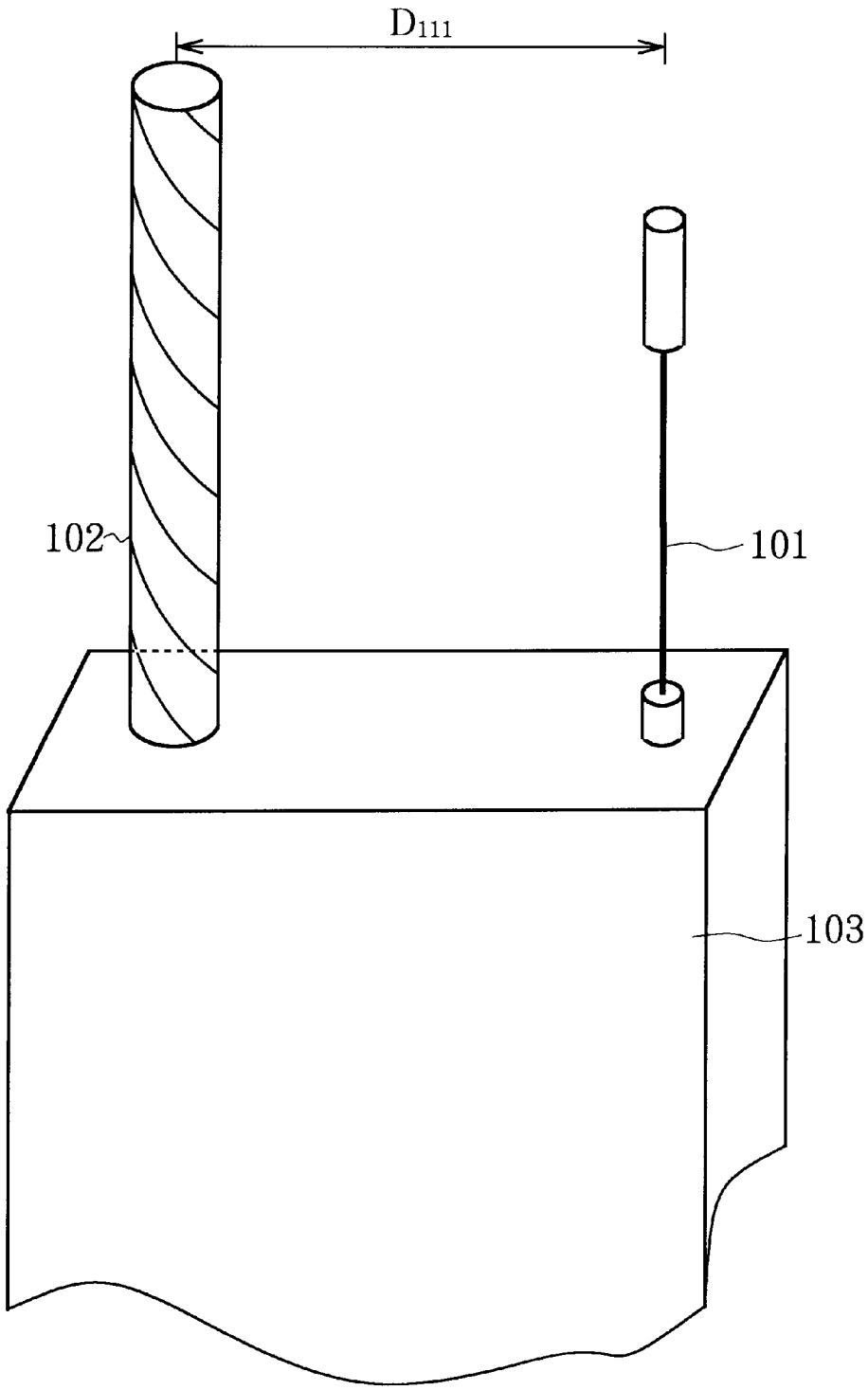
Prior Art Fig. 1
FIG. 1 shows an example of a possible combination based on existing available antennas.
Figure 2:
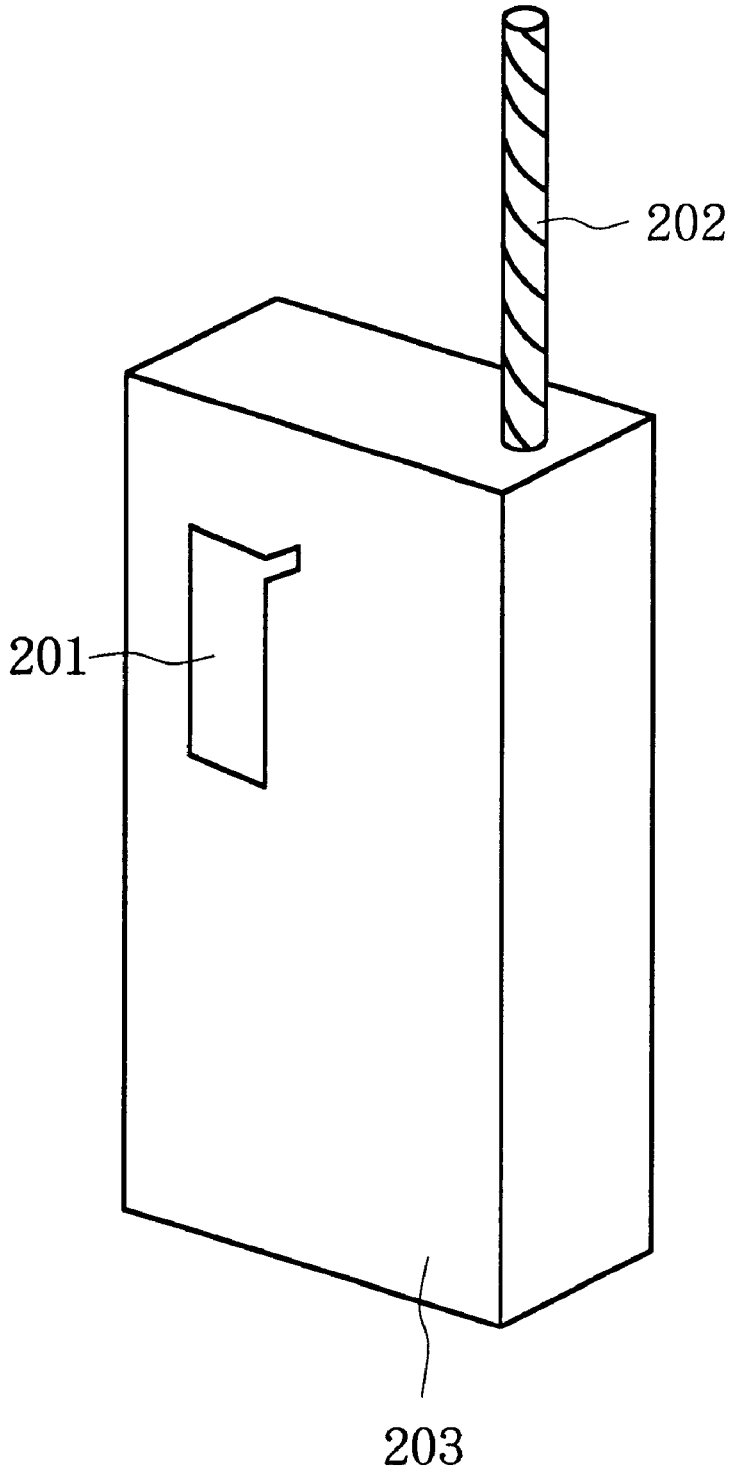
Prior Art Fig. 2
FIG. 2 shows another example of a combination of a PIFA antenna.
Figure 3:
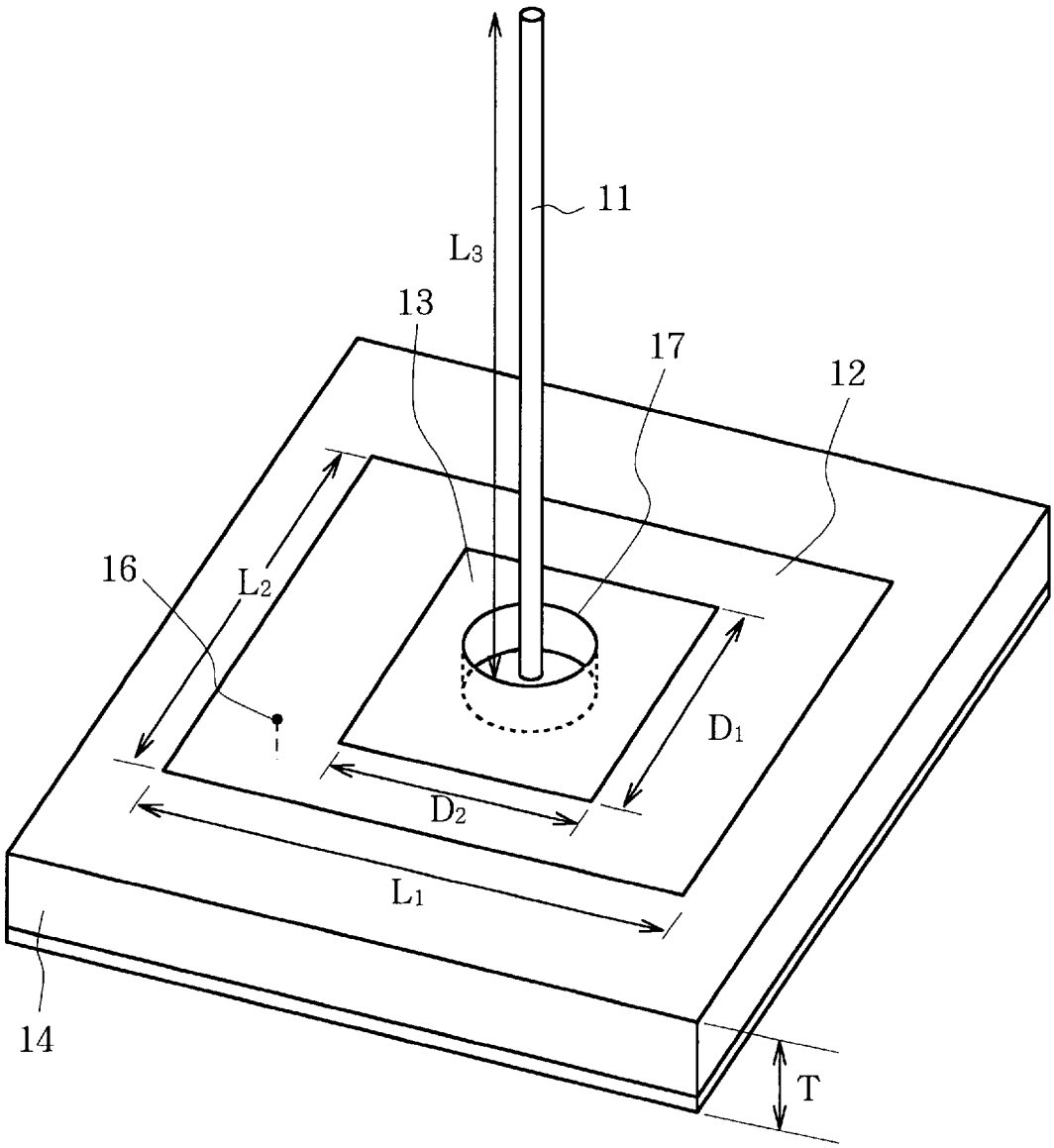
FIG. 3 shows a perspective view of the first embodiment of the present invention.
Figure 4:
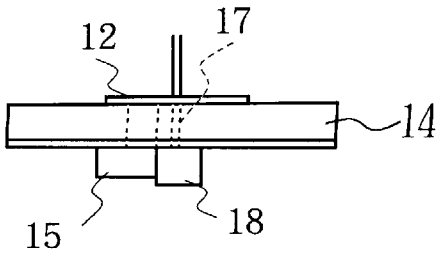
FIG. 4 shows a side view of the first embodiment.

FIG. 3 and FIG. 4 shows the first embodiment of the invention in which a monopole antenna 11 is placed in the axis of a printed patch antenna 12 with a slot 13 in its center. The patch antenna 12 is printed on a backgrounded substrate 14 with a thickness T of 32 mm and a permittivity P of 3.48. The feeding system 15 of the patch antenna 12 is defined as a probe 16 of 1 mm diameter located to achieve the best axial ratio. The slot 13 has dimensions $D_1$ of 15 mm and $D_2$ of 15 mm which are determined to achieve the best axial ratio and allowing to let pass the monopole antenna 11 through a hole 17 going through the entire substrate. The patch antenna 12 has lengths $L_1$ of 38.3 mm and $L_2$ of 37.52 mm which are determined to give circular polarization at a frequency $F_1$ with low axial ratio while the monopole length $L_3$ is determined to be accorded to the frequency $F_2$ of 900 Mhz and allowing the vertical polarization. The feeding system 18 for the monopole antenna 11 is placed behind the patch structure.

Figure 5:
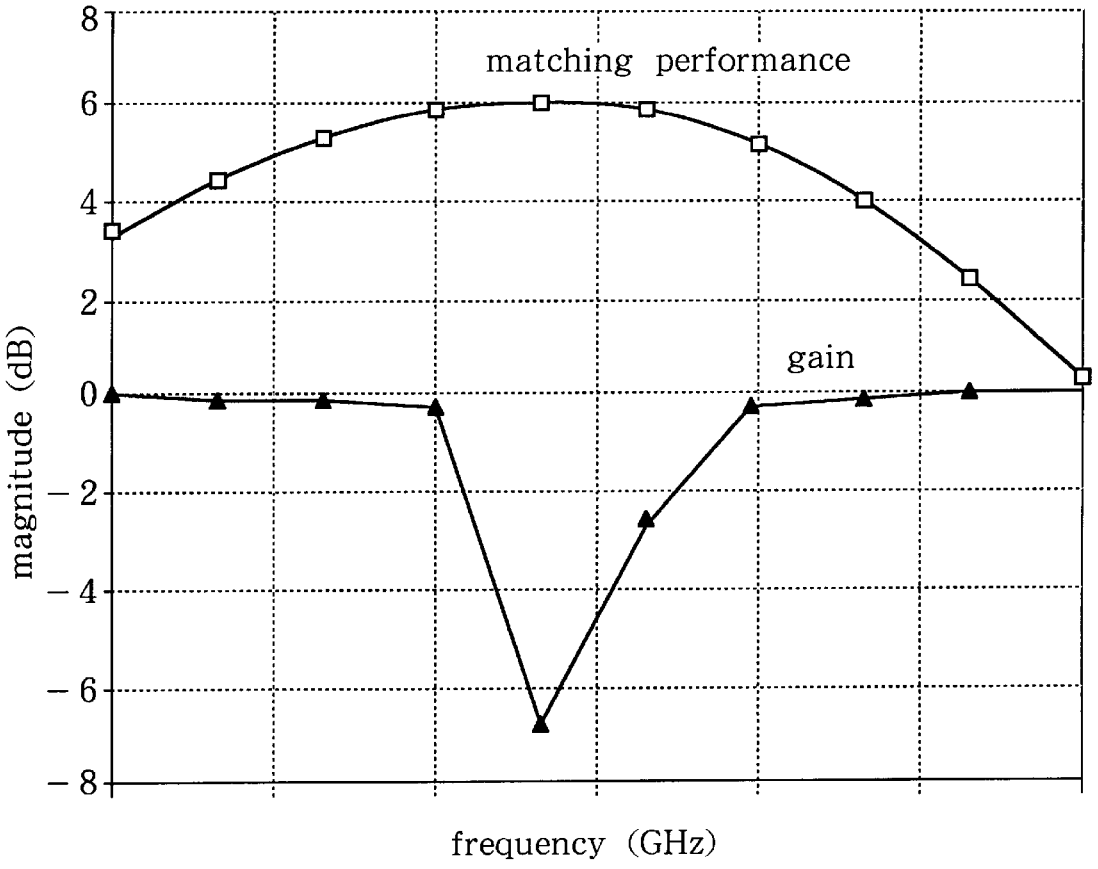
FIG. 5 shows measured radiation patterns for the first embodiment.

In FIG. 5, it is shown the matching performances and the gain of the patch antenna versus the frequency. It exhibits a 7 dB matching and 6 dB circular gain at 1780 MHz.

Figure 6:
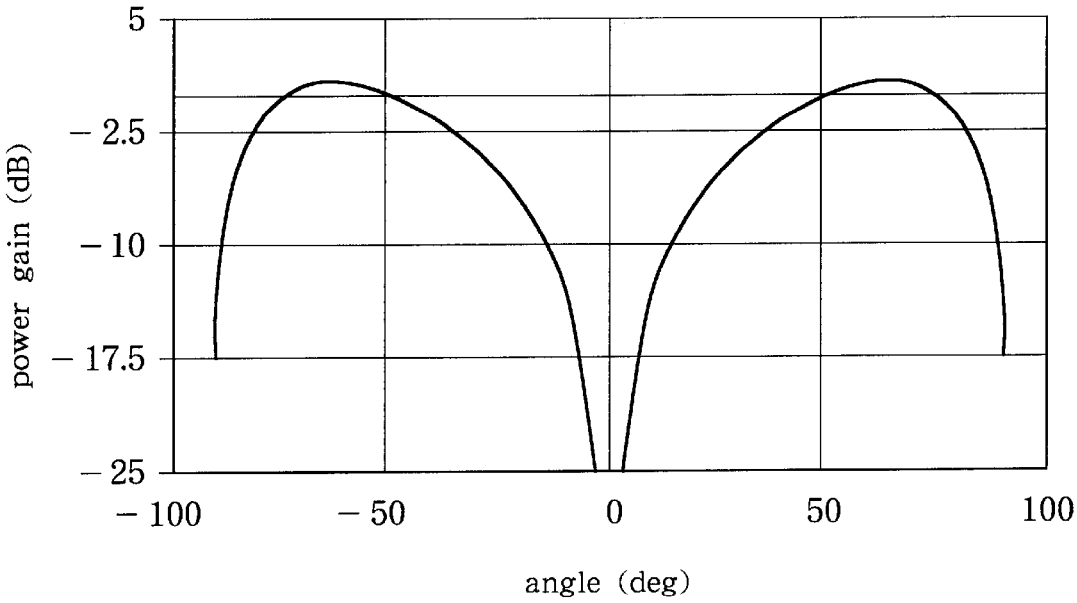
FIG. 6 shows simulated performances for the first embodiment.

FIG. 6 shows the radiation pattern of the monopole antenna accorded to 900 MHz versus the elevation angle. One plot is with and the other without the patch antenna behind it. It is showing that there is no effect on the radiation pattern with a maximum gain of 1.2 dB.

Figure 7:
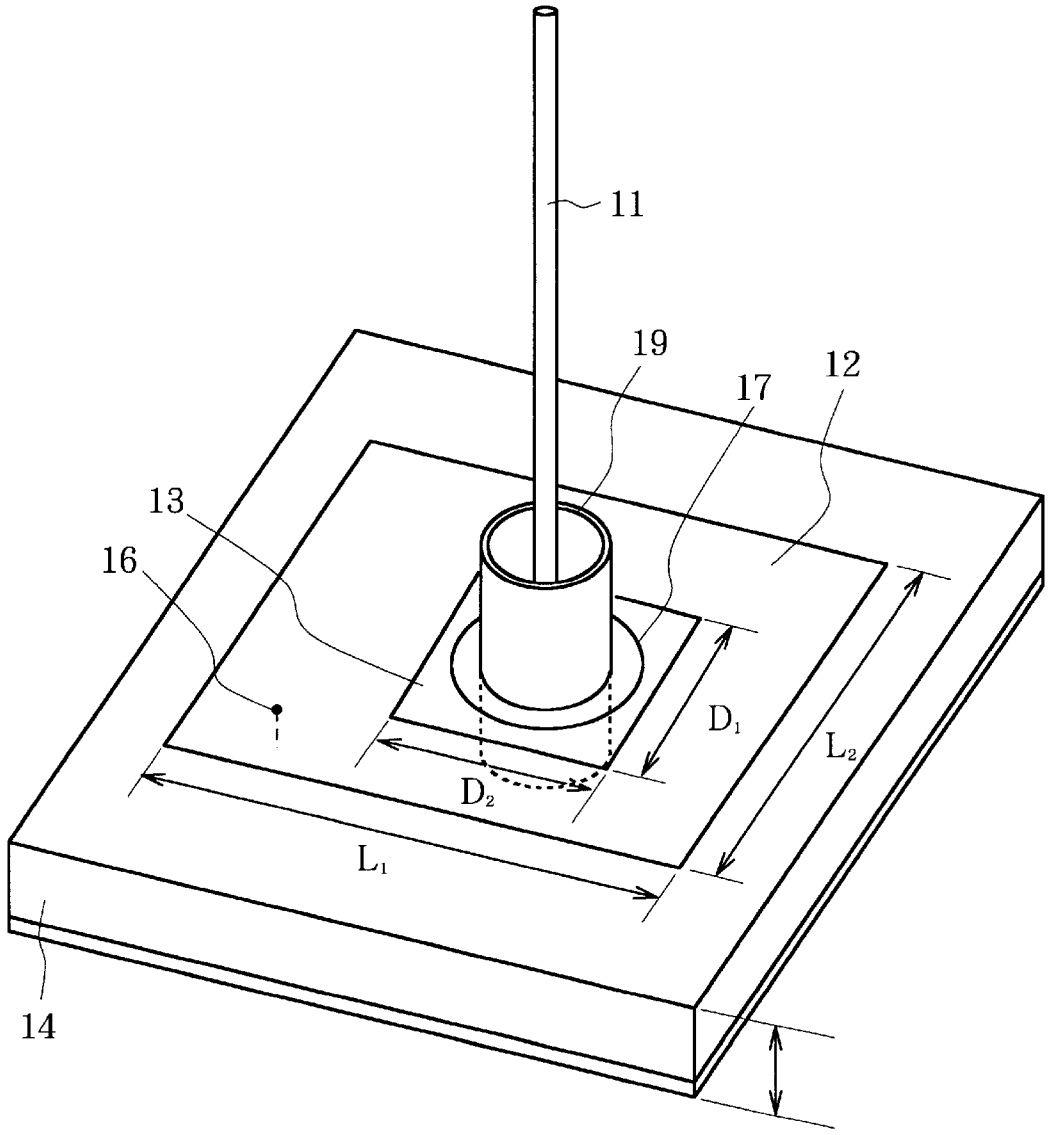
FIG. 7 shows a perspective view of the second embodiment of the present invention.

FIG. 7 shows the second embodiment of the invention in which the multi-mode antenna incorporates instead of the simple hole 17 a complete structure made to match with a specific dipole. This structure is based on a ground plane with a part of a tube 19 of a certain diameter $D_T$ and a height $H_T$. The monopole antenna 11 is placed centered in the middle of this tube 17 which is either in metal or in composite metal.

The monopole antenna 11 may also be replaced by any other type of antenna of this type generating a linear vertical polarization such as a dipole antenna. This type of antenna may be retractable or not.

Figure 8:
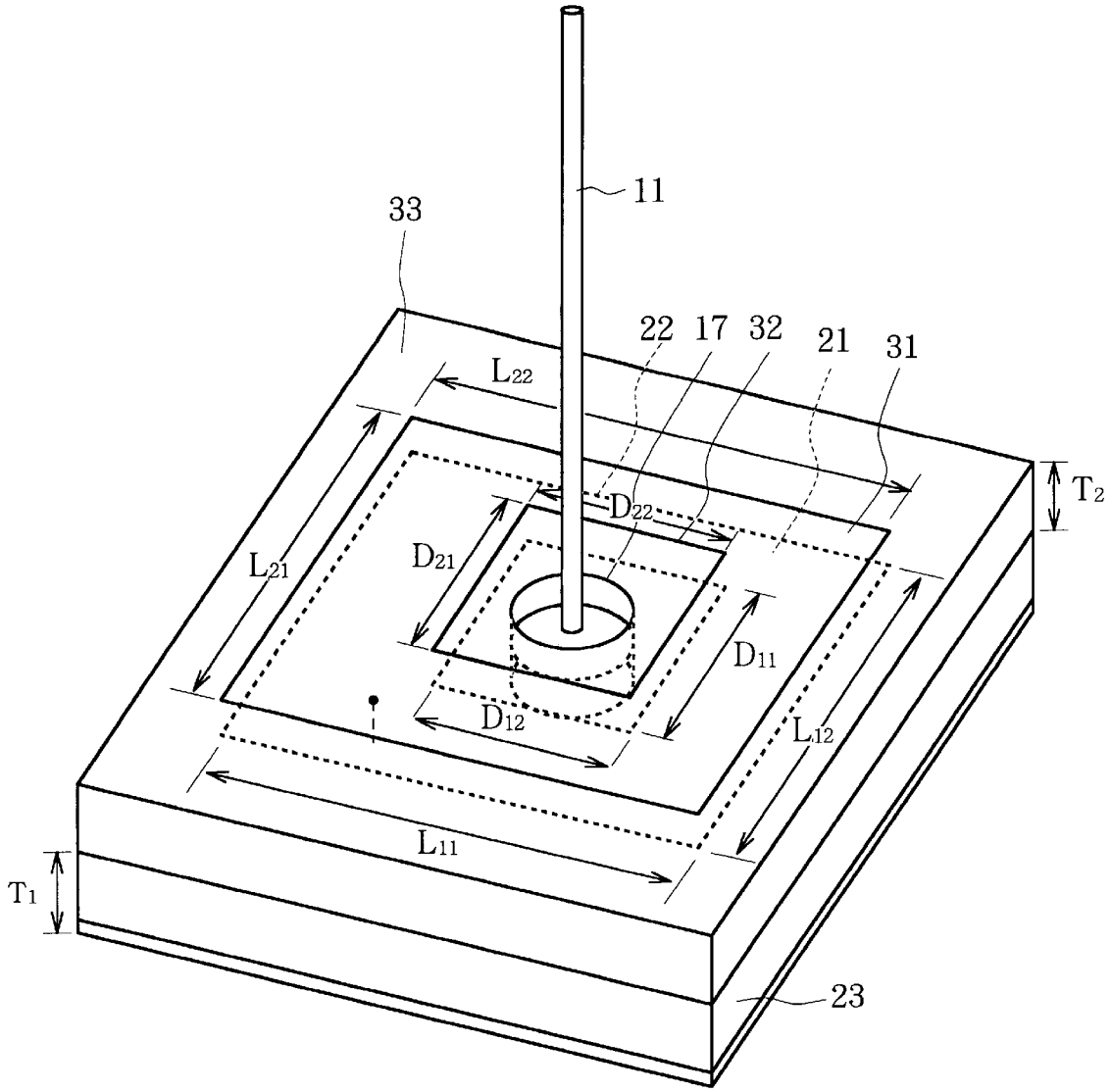
FIG. 8 shows a perspective view of the third embodiment of the present invention.
Figure 9:
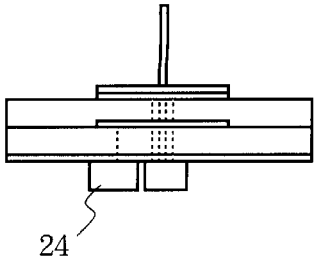
FIG. 9 shows a side view of the third embodiment.

FIG. 8 and FIG. 9 show the third embodiment of the invention in which a monopole antenna 11 is placed in the center of stacked patch antennas 21, 31 with slots 22, 32 in each center.

The first patch antenna 21 is printed on a backgrounded substrate 23 with the thickness $T_1$ of 1.27 mm and the permittivity $P_1$ of 6.15. The feeding system 24 of the patch antenna 21 is defined as a probe of 1 mm diameter. The slot 22 has dimensions $D_{11}$ of 9 mm and $D_{12}$ of 9 mm, lengths $L_{11}$ of 17.9 mm and $L_{12}$ of 19.4 mm and the frequency of operation is $F_1$=2000 Mhz.

The second patch antenna 31 is printed on a non backgrounded substrate 33. The slot 32 is placed at the center of the patch antenna 31 with dimensions $D_{21}$ of 9 mm and $D_{22}$ of 9 mm and lengths $L_{21}$ of 17.7 mm and $L_{22}$ of 19.1 mm for the operation frequency $F_3$ of 2000 Mhz. Through the slots 22, 32 of the first and second patch antennas 21, 31 is going a hole 17 which is able to let through the monopole antenna 11. The length of the monopole antenna 11 is accorded to a frequency of $F_2$ of 900 Mhz.

Figure 10:
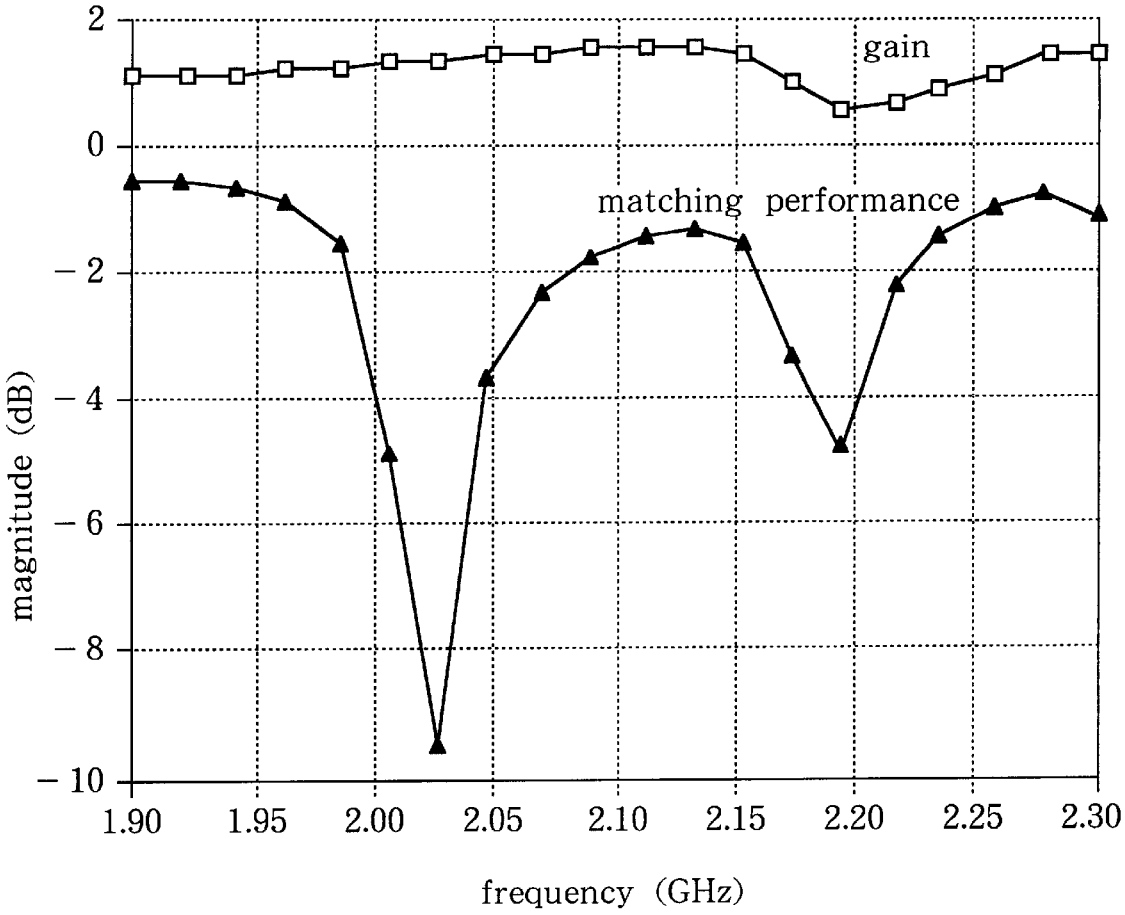
FIG. 10 shows simulated performances for the third embodiment.

FIG. 10 shows the matching performances and the gain of the patch antenna versus the frequency. It exhibits 10 dB of matching and 1 dB of gain at 2000 MHz, and 5 dB of matching and 0.5 dB of gain at 2200 Mhz.

Figure 11:
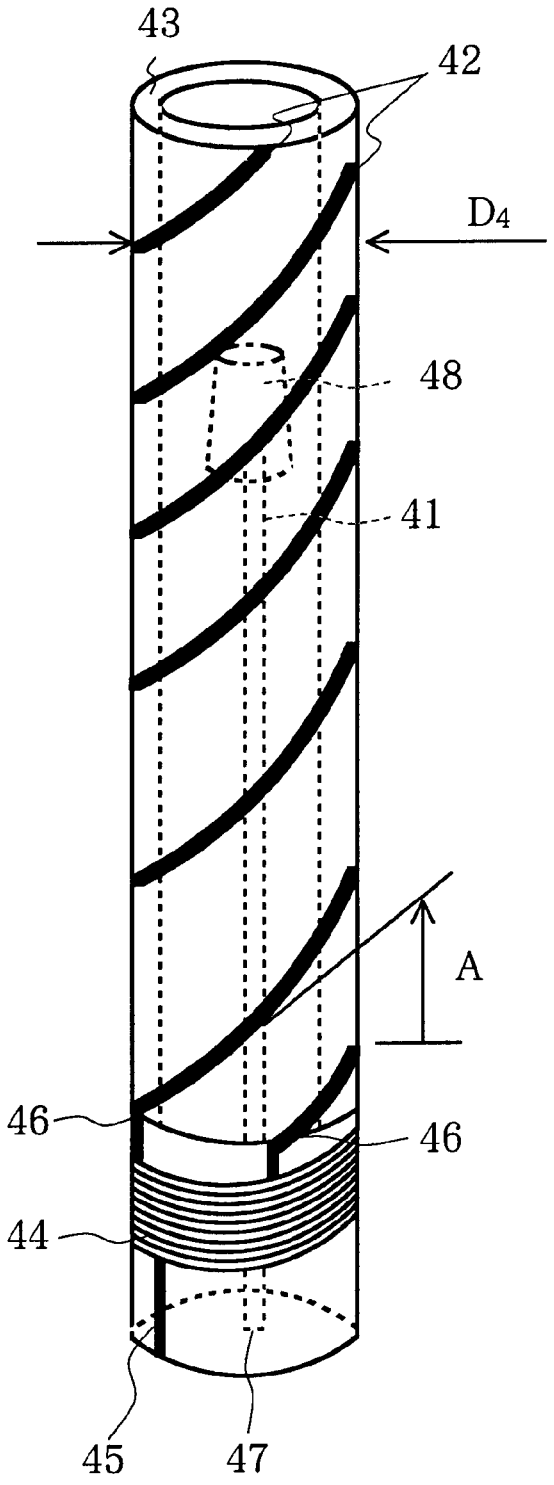
FIG. 11 shows a perspective view of the fourth embodiment of the present invention.

FIG. 11 shows a perspective view of the fourth embodiment of the invention in which a monopole antenna 41 is placed in the axis of a helical antenna 42 which composes N=4 wires wrapped around a transparent cylinder 43 for generating a circular polarization. The monopole antenna 41 is placed to stand above a conducting plane on which this multimode antenna is formed. The conducting plane may be provided by a casing 49 of a communication device. Each of the wires of the helical antenna 42 is connected to individual one of N outputs of a first feeder 44 which have a common entry 45 to feed the N outputs 46 in appropriate way (phase and magnitude). The monopole antenna 41 is connected to a second feeder 47 which is placed along the axis and on the same supporting structure as that of the first feeder 45.

The diameter of the cylinder 43, the number of the wires, the pitch angle A of the wires, the length of the wires and the feeding phases and magnitudes are determining the radiation pattern of the satellite communication system portable antenna. The length $L_3$ of the monopole antenna 41, the loading structure 48 which is terminating the monopole antenna 41 and the surrounding structure are determining the radiation pattern and the matching of the monopole antenna 41. By determining the diameter $D_4$ of the wires, the interaction on the monopole can be optimized.

While, the resonant frequency of the monopole antenna 41 is determined by its length $L_3$ which is approximately a quarter wavelength of the desired frequency. The feeding system and the support structure is designed for having a complete matching and giving power at frequency $F_1$ in a linear polarization for the terrestrial coverage.

Figure 12:
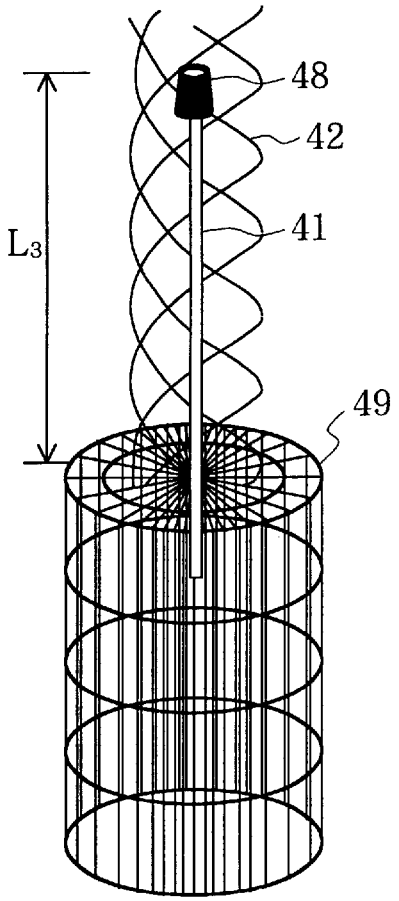
FIG. 12 shows a frame of the fourth embodiment and its supporting structure.

FIG. 12 shows a frame configuration of the fourth embodiment for clarifying the relationship between the monopole antenna 41 and the wires of the helical antenna 42. The casing 49 of a communication device is also shown. Although the casing 49 of this example has cylindrical form, various configurations are available for the casing 49.

Figure 13:
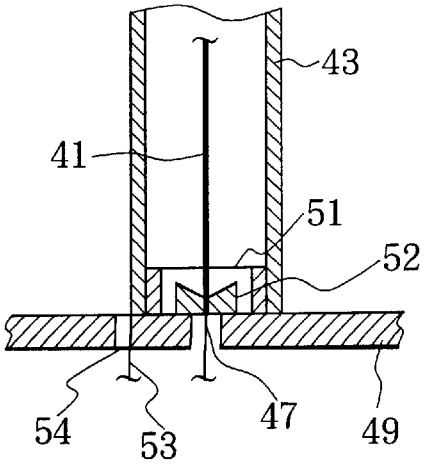
FIG. 13 shows a cross sectional side view of the fourth embodiment.

FIG. 13 is a cross sectional view of this embodiment to show the supporting structure for the antenna. The cylinder 43 is supported by its inside on a cylindrical guide member 51 provided on the casing 49 while the monopole antenna 48 is supported by a supporting member 52 provided on the inside of the guide member 51. The entry 45 of the feeder 44 is connected to a lead 53 which is introduced into the casing 49 via a through hole 54 provided on the outside of the cylinder 43. The entry of the monopole antenna 41 is introduced into the casing 49 via through holes provided on the supporting member 52 and the corresponding position of the casing 49.

Figure 14:
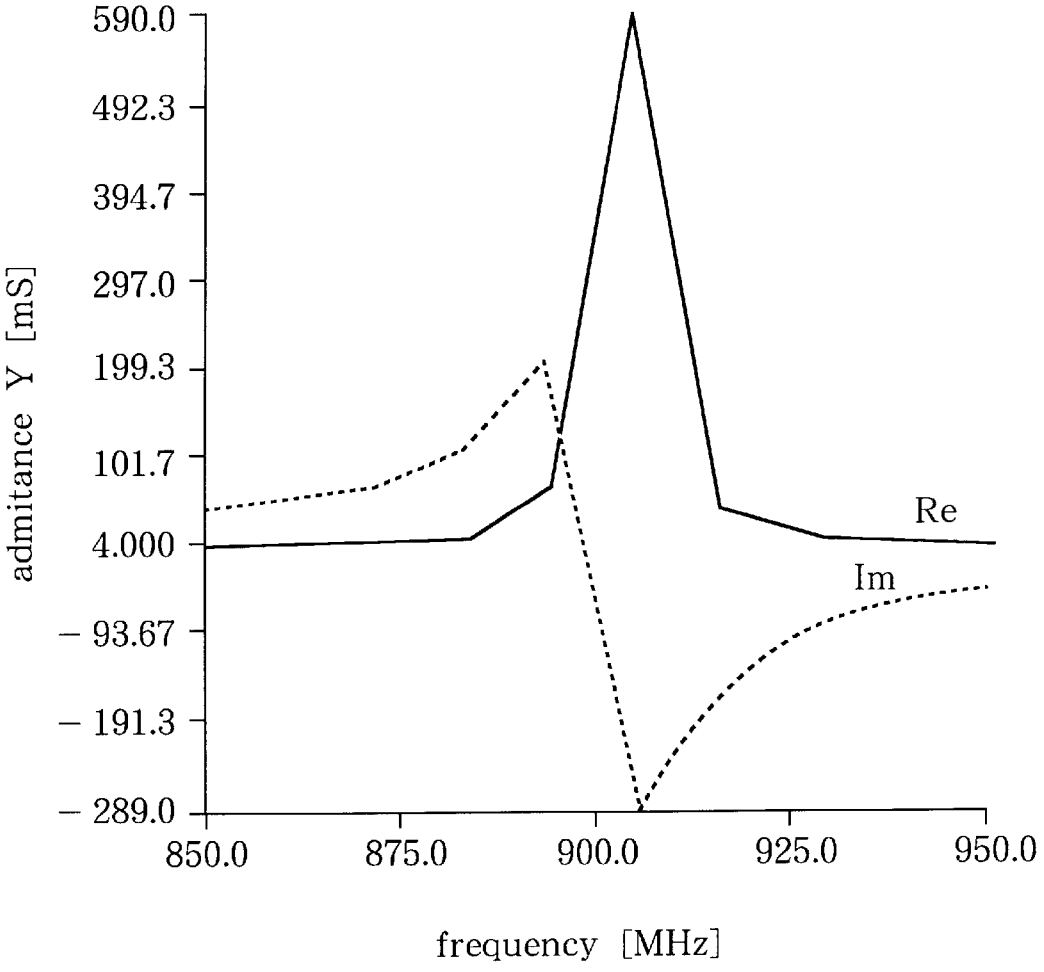
FIG. 14 shows measured radiation performances for the fourth embodiment.

FIG. 14 shows an example of measured matching performances for the monopole antenna 41. In this measurement, The helical antenna 42 is defined by a 4 wires set wrapped around the cylinder 43 of 10 mm diameter with one turn rotation, and a total vertical height of 100 mm. The monopole antenna 41 has in this case a length of 83 mm.

Figure 15:
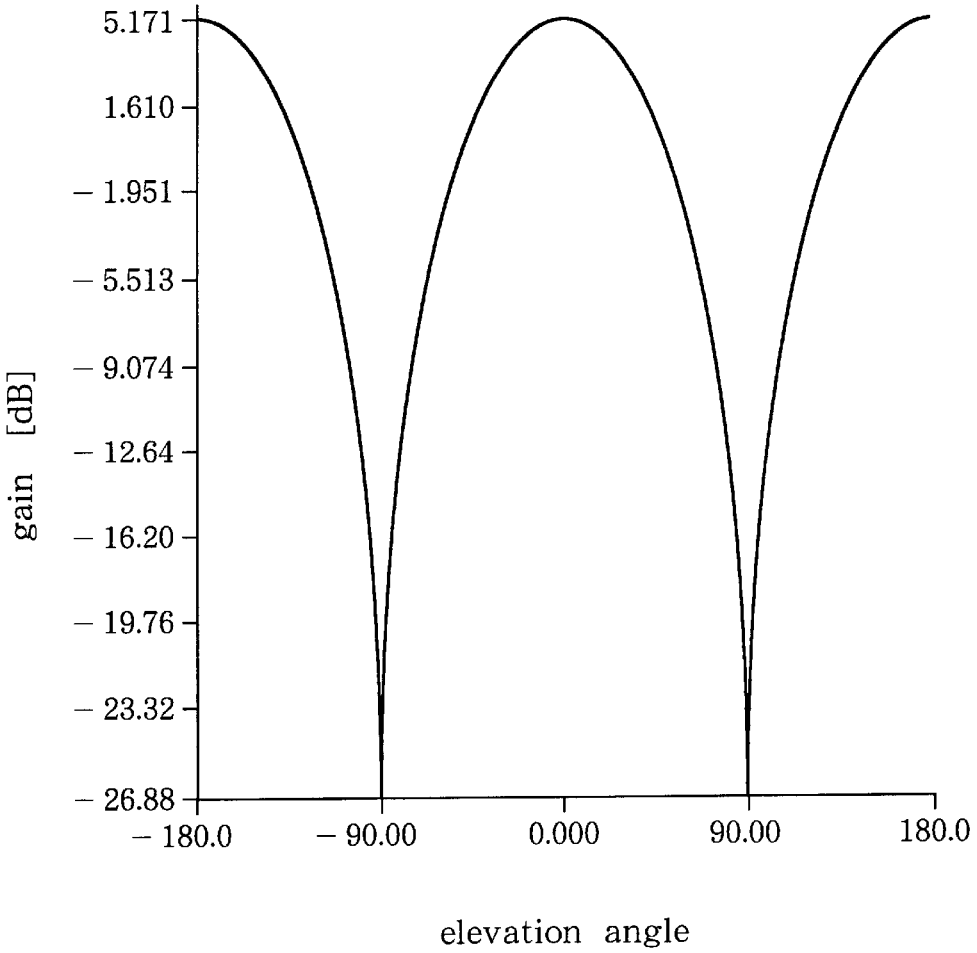
FIG. 15 shows measured radiation performances for the fourth embodiment.

FIG. 15 shows a measured diagram of the monopole at 950 Mhz. The variation is made on the elevation angle and the obtained gain is around 5 dBi.

Figure 16:
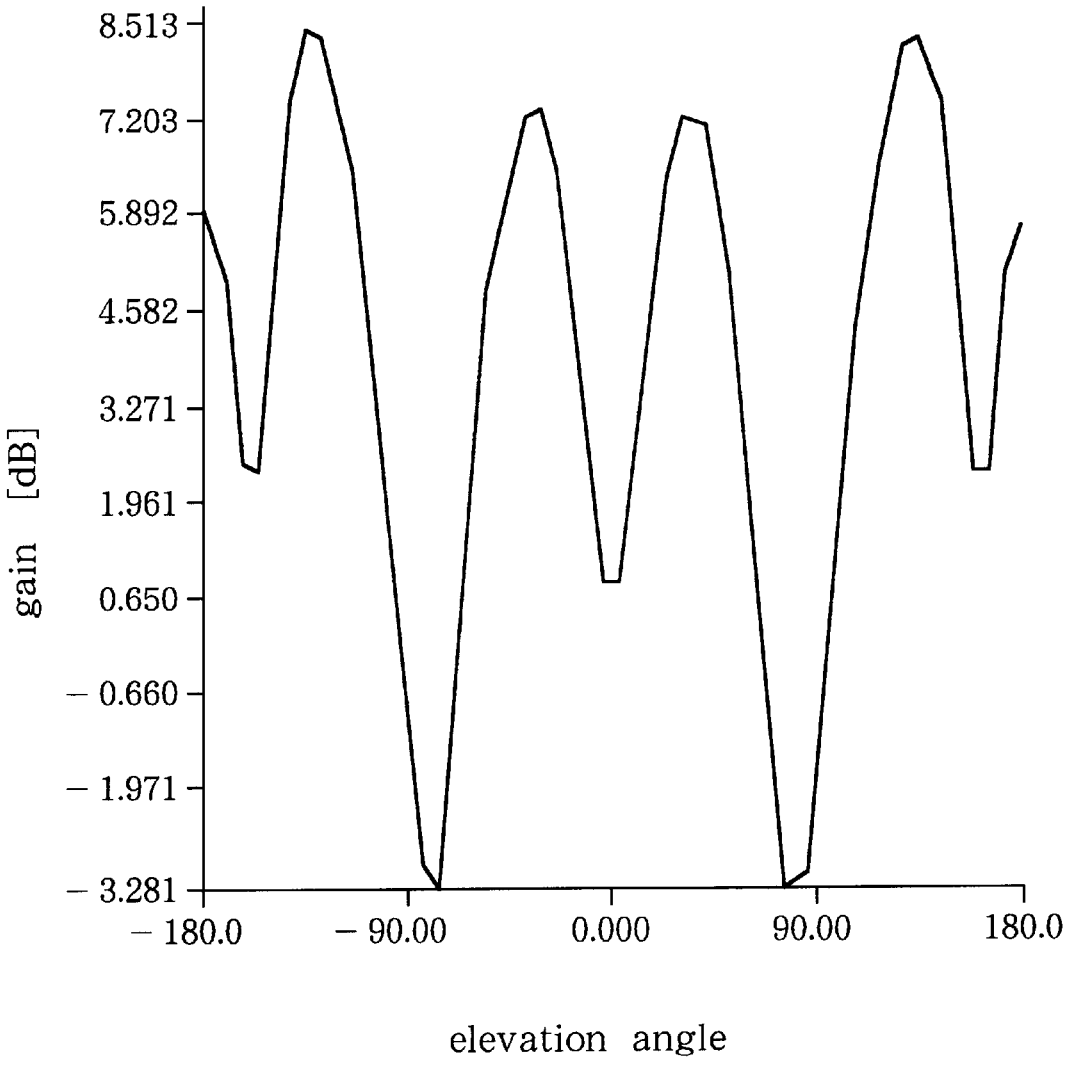
FIG. 16 shows measured radiation performances for the fourth embodiment.

FIG. 16 shows a radiation pattern in the elevation plane for the helical antenna alone. It exhibits a gain of 8.5 dBi.

Figure 17:
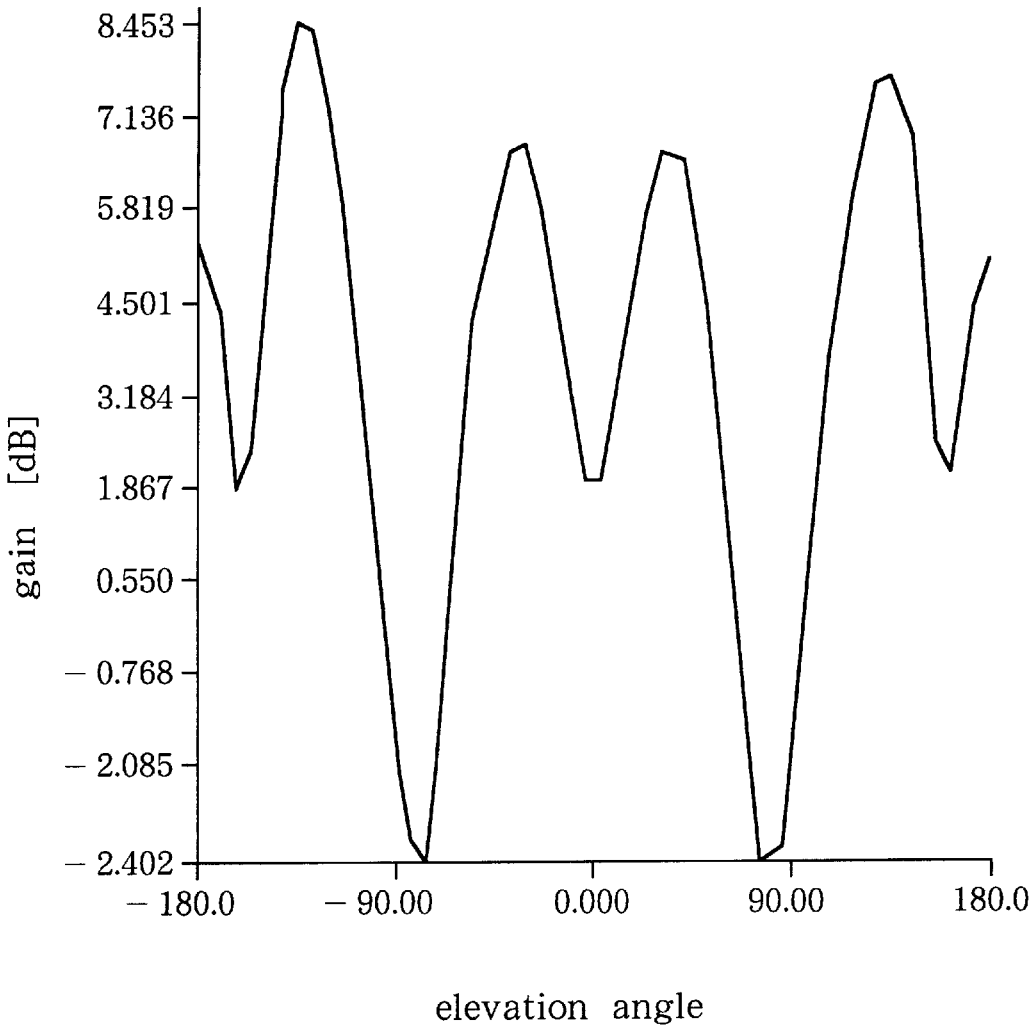
FIG. 17 shows measured radiation performances for the fourth embodiment.

FIG. 17 shows a radiation pattern of the helical antenna with the monopole inside exhibiting in this case almost the same pattern.

What is claimed is:

1. A multi-mode antenna having multiple working frequencies and polarizations comprising:

a linear antenna having a linear axis and a circularly polarized antenna which generates a circular polarization and which has an axis through a geometric center thereof, wherein said linear axis of said antenna coincides with said axis of said circular polarized antenna, and wherein the circular polarized antenna is a patch antenna printed on a substrate, said substrate and said patch antenna having an opening into which said linear antenna is placed, said patch antenna further including in addition to said opening, a slot dimensioned to optimize the axial ratio.

2. The multi-mode antenna claimed in claim 1, wherein the patch antenna is printed on a backgrounded substrate.

3. The multi-mode antenna claimed in claim 1, wherein the slot has dimensions determined to achieve the best axial ratio and allowing to let pass the linear antenna through said opening going through the entire substrate on which the patch antenna is printed.

4. The multi-mode antenna claimed in claim 1, wherein the patch antenna has dimensions determined to give circular polarization at one frequency with low axial ratio while the length of the linear antenna is determined to be accorded to another frequency and allowing a vertical polarization.

5. The multi-mode antenna in claim 1, wherein the linear antenna is connected to a feeding system placed behind the patch antenna.

6. The multi-mode antenna claimed in claim 1, wherein the linear antenna is placed within a tube which is placed in the center of the slot and the opening in the slot and substrate on which the patch antenna is printed.

7. The multi-mode antenna claimed in claim 1, wherein the circular polarized antenna includes stacked patch antennas in which one of the patch antennas is printed on a backgrounded substrate and each of the other patch antennas is printed on a non backgrounded substrate.

* * * * *